US005746279A

United States Patent [19]

Havlinek et al.

[11] Patent Number: 5,746,279

[45] Date of Patent: May 5, 1998

[54] METHOD AND APPARATUS FOR CHANGING BITS WHILE DRILLING WITH A FLEXIBLE SHAFT

[75] Inventors: Kenneth Havlinek, Missouri City; Thomas D. MacDougall, Sugar Land; Alan Sallwasser, Houston; Miles Jaroska, Richmond; Duane LaDue, Sugar Land; Wayne A. Tyler, Pearland; Mario Flores, Houston; Mark L. Hinton, Sugar Land; Thomas D. Svoboda, Pasadena; Michele Tesciuba, Houston, all of Tex.

[73] Assignee: Gas Research Institute, Chicago, Ill.

[21] Appl. No.: 602,485

[22] Filed: Feb. 20, 1996

[51] Int. Cl.[6] ..... E21B 29/06; E21B 43/112

[52] U.S. Cl. ..... 175/52; 166/55.1

[58] Field of Search ..... 166/55.1, 55.7; 175/52

[56] References Cited

U.S. PATENT DOCUMENTS

| | | | |
|---|---|---|---|
| 2,392,683 | 1/1946 | McWhorter | 175/52 |
| 3,976,149 | 8/1976 | Granholm et al. | 175/52 X |
| 4,065,845 | 1/1978 | Strom et al. | 175/52 X |
| 4,226,288 | 10/1980 | Collins, Jr. | 175/62 |
| 4,658,916 | 4/1987 | Bond | 175/81 |
| 5,195,588 | 3/1993 | Dave | 166/264 |

FOREIGN PATENT DOCUMENTS

| | | | |
|---|---|---|---|
| 0691484 | 10/1996 | European Pat. Off. . | |
| 794197 | 1/1981 | U.S.S.R. | 166/55.1 |

*Primary Examiner*—David J. Bagnell

*Attorney, Agent, or Firm*—Speckman, Pauley & Fejer

[57] ABSTRACT

An apparatus and method are disclosed for the removal and replacement of the used drill bit after each perforation through casing, cement, and into rock while using a flexible drive shaft. This apparatus involves both a bayonet-style "quick connector" between the flexible shaft and the drill bit and a cartridge that holds the drill bits while they await their turn to be used. The apparatus also has a means for indexing the cartridge so that the flexible shaft can have access to each of the drill bits in the cartridge. The method disclosed involves the process of connecting the flexible shaft to the drill bit at the start of the perforating process, the disconnecting of the used bit at the end of the perforation, and the indexing of the cartridge so that the next drill bit is in line with the flexible shaft for the next perforation.

21 Claims, 7 Drawing Sheets

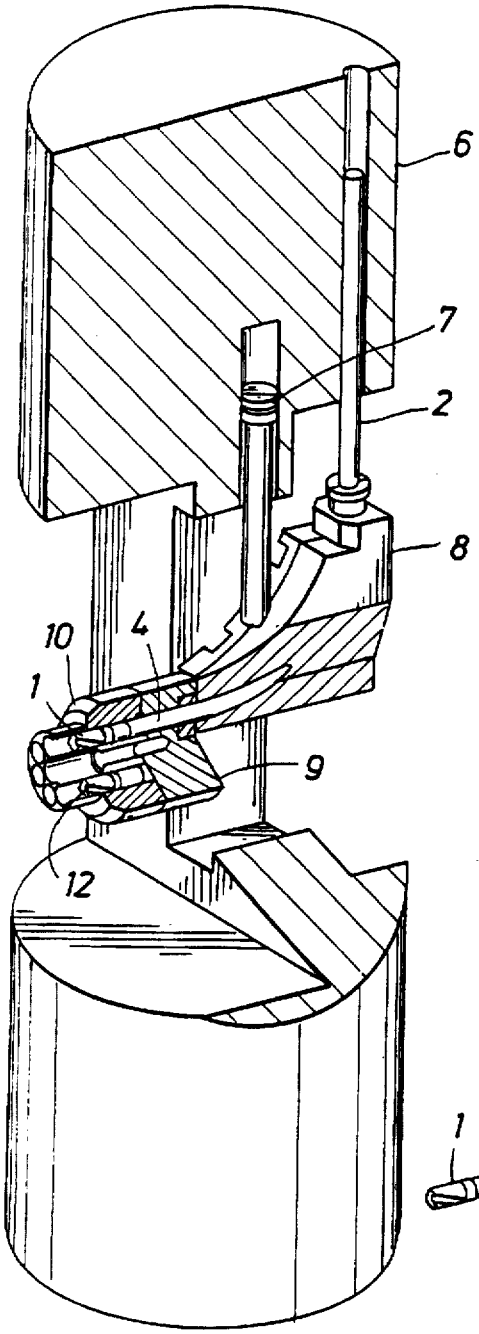
FIG. 3a
FIG. 3b
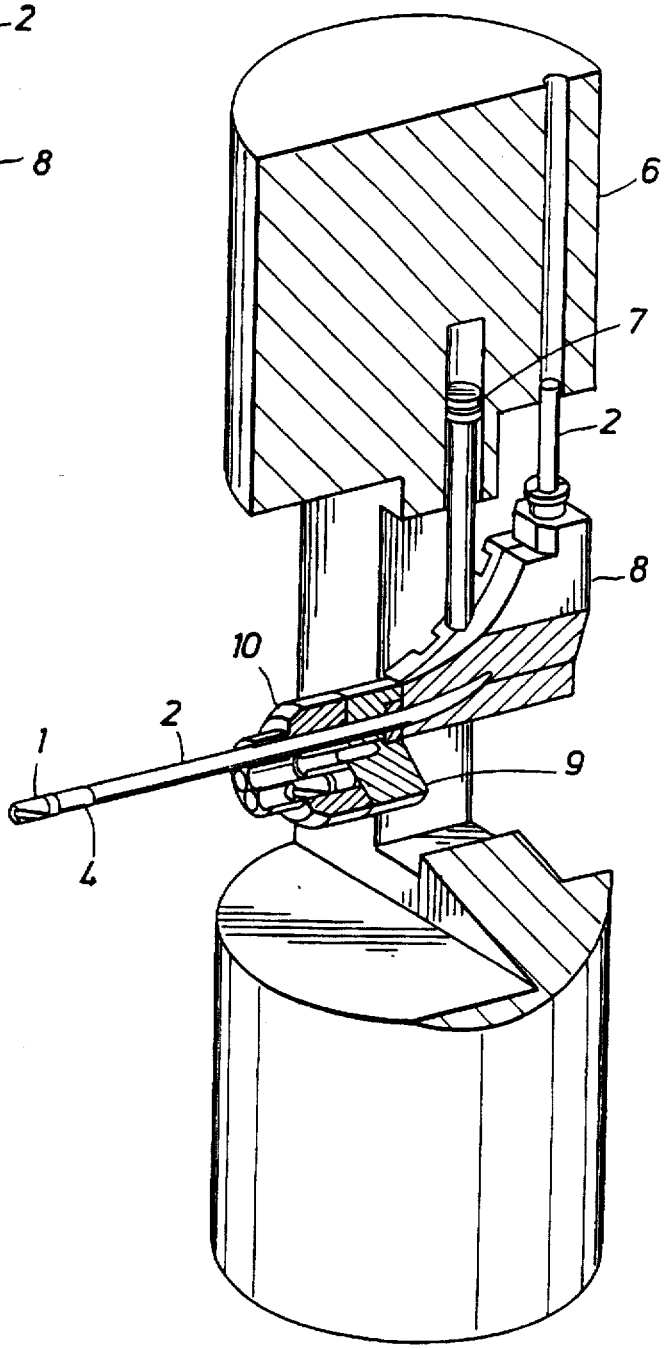

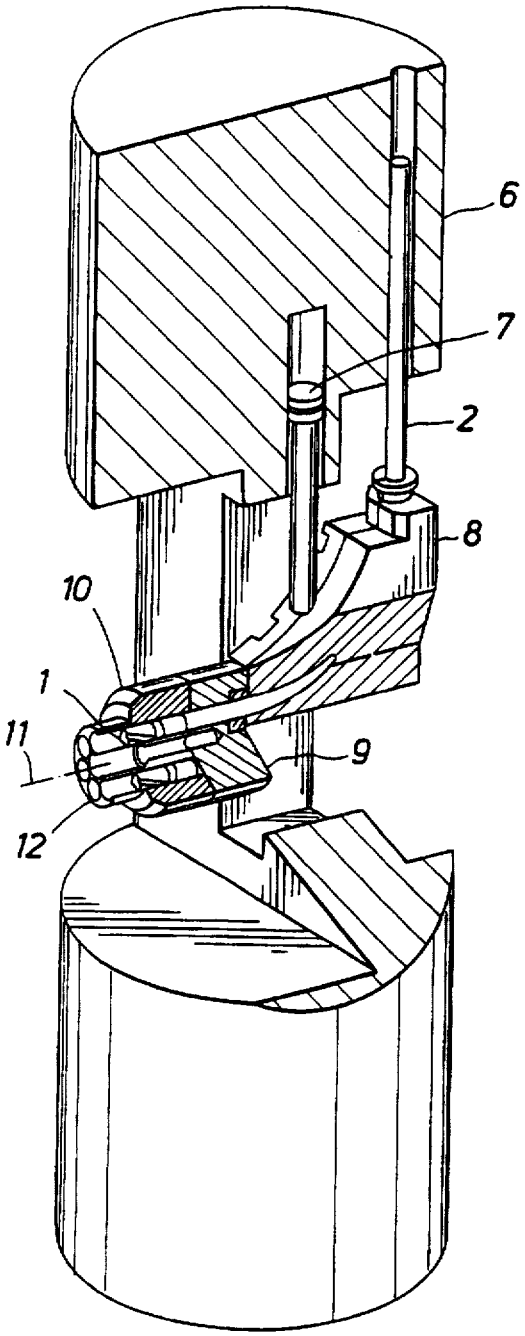
FIG. 4a
FIG. 4b
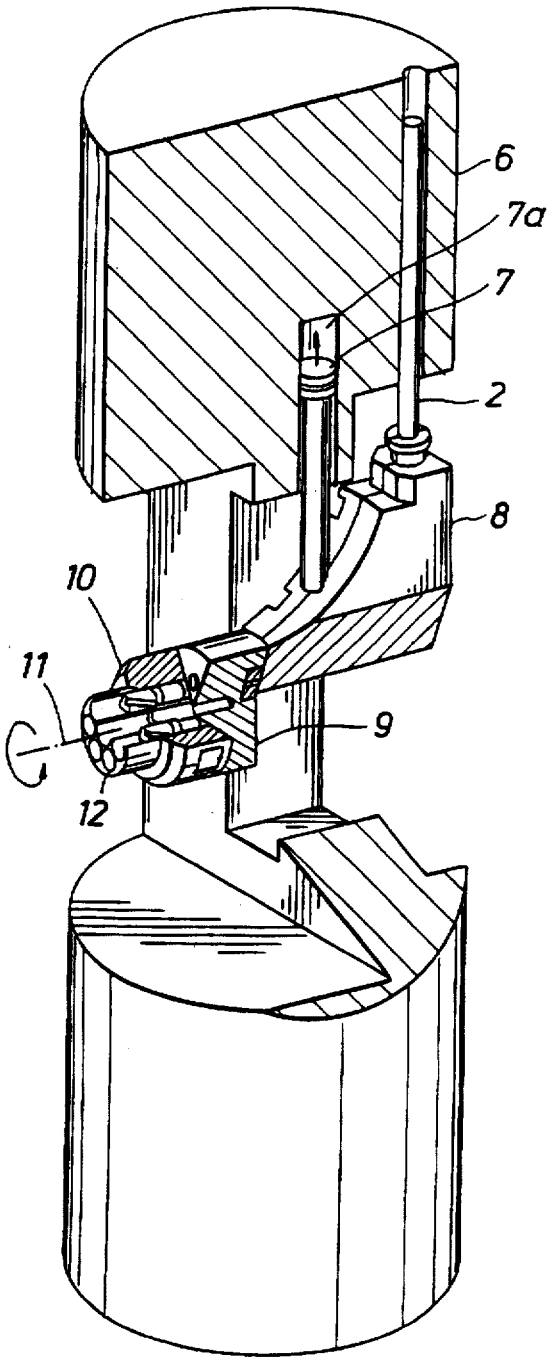

FIG. 4c
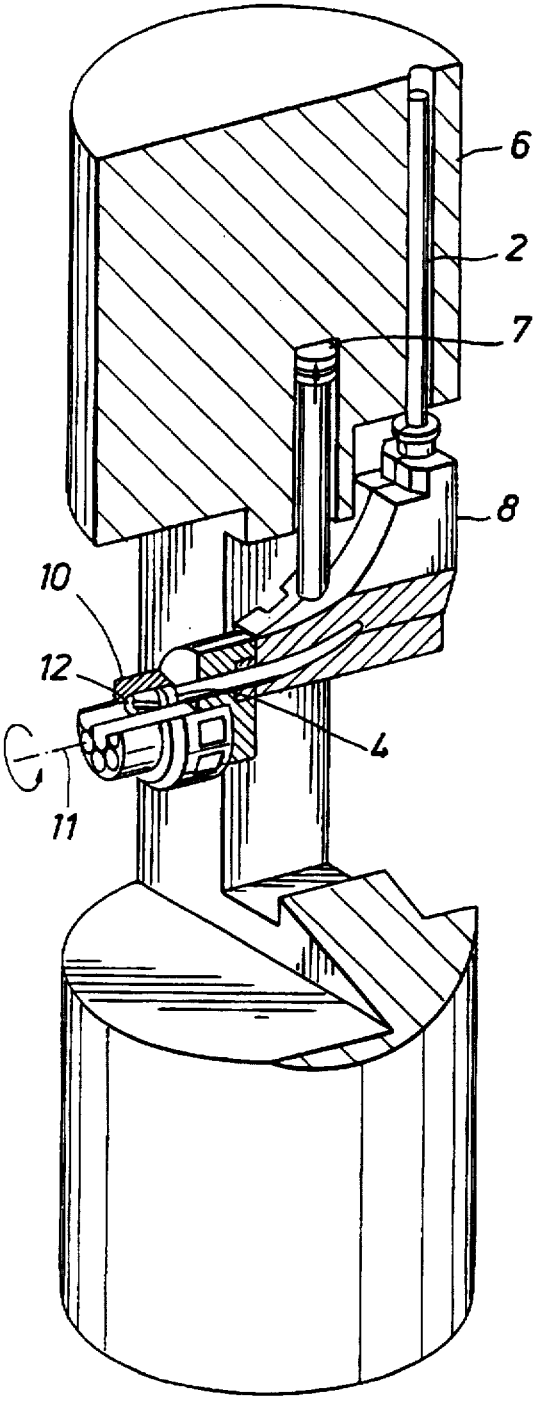
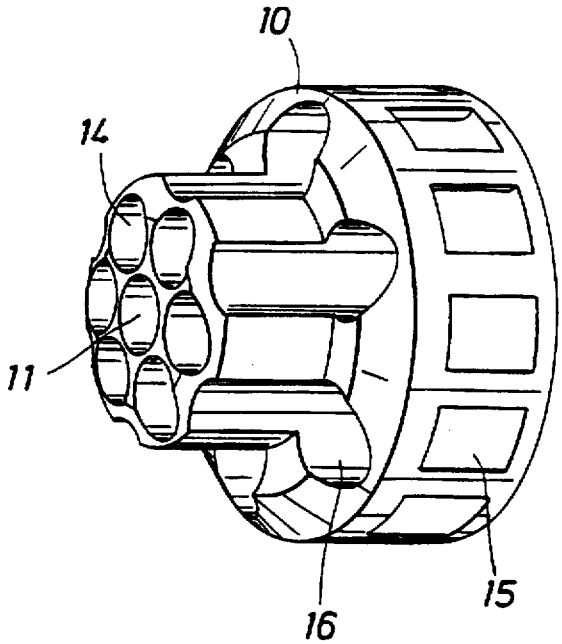
FIG. 7

METHOD AND APPARATUS FOR CHANGING BITS WHILE DRILLING WITH A FLEXIBLE SHAFT

FIELD OF THE INVENTION

This invention relates to the field of investigating earth formations surrounding a borehole using a flexible shaft to drill perforations through a borehole wall and into the earth formation. More particularly, this invention relates to the replacement of the dulled drill bit with a new drill bit after each perforation in order to increase the life of the flexible shaft.

BACKGROUND OF THE INVENTION

The use of a flexible shaft in drilling operations has been done for years. A number of drilling systems have been proposed where the drilling bit is driven by a flexible shaft. One such system that can be implemented in oil and gas production is described in U.S. Pat. No. 4,658,916 (Bond). This patent utilizes a flexible drill shaft that is operable primarily from the vertical borehole when drilling in the formation in a direction that is along a generally horizontal path for a significant distance of lateral drilling away from the borehole thereby to enlarge formation contract area.

Generally, the motivation for using a flexible shaft is to overcome space limitations on the drilling equipment. A flexible drilling shaft will enable the drilling of a hole which is deeper than the headroom available above the hole to be drilled. For example, in the coal mining industry, roof bolt holes are drilled into the ceiling of coal seams to a depth which can reach three times the height of the coal seem itself. In oil and gas wells it is often necessary to drill holes perpendicular to the borehole wall which are deeper than the internal diameter of the borehole. This need also applies in cased wells. In these situations, to drill such holes requires a system where a flexible drilling shaft is fed around a bend into the hole as the drilling progresses. It is important to note that the available space in these cased wells is far smaller than in previous flexible drilling shaft applications. Rather than three feet of height in coal mines, inner diameters of cased wells tend to be five inches or less. Therefore, the drilling mechanism and the flexible shaft must be much smaller in scale.

For cased well applications, a flexible shaft, with fittings at both ends, is operated in a tubing of fixed curvature. The fittings are used to permit easy connection of the shaft to another assembly, such as the drive motor shaft and the drill bit. To facilitate drilling, the drill bit not only must be torqued so that it rotates about it's central axis (measured in "revolutions per minute" or "RPM"), but also it must be thrusted against the material to be drilled. This thrust is referred to as "weight-on-bit" or "WOB". In a drilling system that uses a flexible drilling shaft, both of these forces are typically applied to the bit through the flexshaft. An analysis of a flexible shaft in operation would yield an aggregate force balance of torques, moments and axial forces, each which would produce a deformation of the shaft.

During drilling of the steel casing, it has been found that the shafts experience large axial compressive forces. These forces tend to induce helixing and shorten the effective length of the shafts. Also, due to the high stress, the shaft life will be shortened. It is desirable to have a long shaft life not only for system reliability, but also to increase the allowable number of drilled holes before one must retrieve the mechanism from the well and replace the worn shaft. Thus, it is important to minimize, or eliminate, the stress elements within the shaft.

Another problem that has been recognized with such systems is the dulling of the drill bit. After perforating the steel casing, the flexible shaft must continue applying torque and thrust, albeit at lower values, while the drill bit cuts through several inches of cement. Then, in many cases, it is desirable to continue drilling into the rock, which is typically shale, limestone, or sandstone. A common component of many of these formations is quartz, a crystalline substance that is much harder than any cutting edge of typical drill bits (except for diamond, which cannot be used as it cannot drill through steel). These quartz particles dull the bit enough so that it requires higher values of torque and WOB in order to continue drilling.

Though these increased values do not pose a problem in the cement or rock (as the initial torque and thrust were very low), they do while trying to drill steel in subsequent perforations. As previously noted, the high thrust required in order to successfully drill steel greatly shortens the life of the shaft. Once the bit dulls, the required thrust gets even larger. It has been found that after drilling only a couple of inches into sandstone, the bit is too dull to start another perforation while being driven by a flexible shaft. If one attempts to generate the required thrust, the flexible shaft is often destroyed.

This problem can be mitigated if the dulled bit is replaced after each perforation with a sharp new bit. If this is accomplished, the peak stresses within the flexible shaft will be minimized, and the life of the shaft will be maximized.

Thus, there remains the need for a system that removes the dull bit from the end of the flexible shaft and replaces it with an unused sharp bit. There is also a need for a mechanism that can store a plurality of drill bits for this operation.

SUMMARY OF THE INVENTION

It is an object of this invention to increase the life of the flexible drilling shaft.

It is another object of the invention to reduce the stress on the shaft during drilling.

It is another object of the invention to use a mechanism that allows for the removal and replacement of the used drill bit on the end of the flexible shaft.

It is another object of the invention to use a cartridge that stores a plurality of drill bits that can be accessed by the removal and replacement mechanism.

The present inventions comprises a particular type of connector used between the flexible shaft and the bit, a method to attach (and ultimately detach) the bit to the shaft, a cartridge to hold several drill bits, and a mechanism that indexes this cartridge for access to all of the bits.

The mechanism that connects the shaft to the drill bit needs to provide a "quick" connection between the bit and shaft. One connection mechanism is commonly referred to as a "bayonet-style" connector. Similar connections are used to attach bayonets to rifles or to connect wires to various stereo components. As the flexible shaft advances toward the backside of the drill bit (which is still held in the cartridge), the shaft is slowly rotated normally in the clockwise direction. This rotation allows the bayonet-style connector to engage. Now connected, the shaft and bit advance toward the material (usually casing) to begin drilling the hole. When the drilling procedure is complete, the flexible shaft is retracted (still turning clockwise) until the dulled bit is back inside the cartridge. At this point, the motor turning the flexible shaft is reversed, and the shaft begins turning counter-clockwise. This allows the bayonet-style connector to disengage, which leaves the used bit in it's original place in the cartridge.

The cartridge that holds the bits can be of many different designs. One of the designs that fits best into the geometric constraints of the drilling system is referred to as the "revolver". Much like the cylindrical-shaped cartridge used in a "six-shooter" pistol, this revolver holds at least six drill bits aligned about a radius. After each bit is used and is disengaged from the flexible shaft, the revolver is rotated so that a new bit aligns with the flexible shaft, ready for the next drilling operation. This process can continue until all of the bits within the revolver have been used.

In order to know how many bits have been used and the number of unused bits that remain, there is a need to index the cartridge. There are many ways to index the cartridge, or in this case, the revolver. One of the designs that fits best into the geometric constraints is referred to as the "ratchet" mechanism. After each hole is drilled and the dulled drill bit is deposited into the revolver, a piston is hydraulic actuated. This piston is connected to the base on which the revolver is positioned. As the piston moves in a direction away from the revolver, so does the base and so does the revolver move in that same direction. As the revolver moves, a rotation mechanism causes the revolver to rotate. One such mechanism is a spring-loaded "finger" engages a saw-toothed groove (in the side of the revolver) and causes the revolver to rotate. The mechanism is designed so that the revolver rotates exactly the amount needed for the next drill bit to align with the flexible shaft. Ball detents in the base can be used to account for any tolerancing errors. In order to reset the ratchet system, the piston is moved back to the previous revolver position. This time, however, the finger slides up the ramp of the saw-tooth groove and does not create enough force to cause any counter rotation of the revolver.

The system of the present invention is simple, robust, and can be built into the small diameter tool package capable of passing into the internal diameter of the casing. It constitutes a great improvement over previous flexible shaft drilling systems whereby a single bit was used and, due to the short life of the shaft, only a couple of successive drilling operations could be performed before failure.

BRIEF DESCRIPTION OF THE DRAWING

FIG. 3*a* is an isometric assembly drawing that illustrates the interaction of the flexible driveshaft, drill bits, and revolver with the drilling system in the starting position.

FIG. 3*b* is an isometric assembly drawing that illustrates the interaction of the flexible driveshaft, drill bits, and revolver with the flexible shaft extended.

FIG. 4*a* is an isometric assembly drawing that illustrates how the hydraulic piston moves the base and revolver with the piston being in a more downward position.

FIG. 4*b* is an isometric assembly drawing that illustrates how the hydraulic piston moves the base and revolver with the piston being in a more central position.

FIG. 4*c* is an isometric assembly drawing that illustrates how the hydraulic piston moves the base and revolver with the piston being in a more upward position.

FIG. 7 is a schematic of revolver used in a plugging embodiment of the present invention.

DETAILED DESCRIPTION OF THE PREFERRED EMBODIMENT

Figure 1:
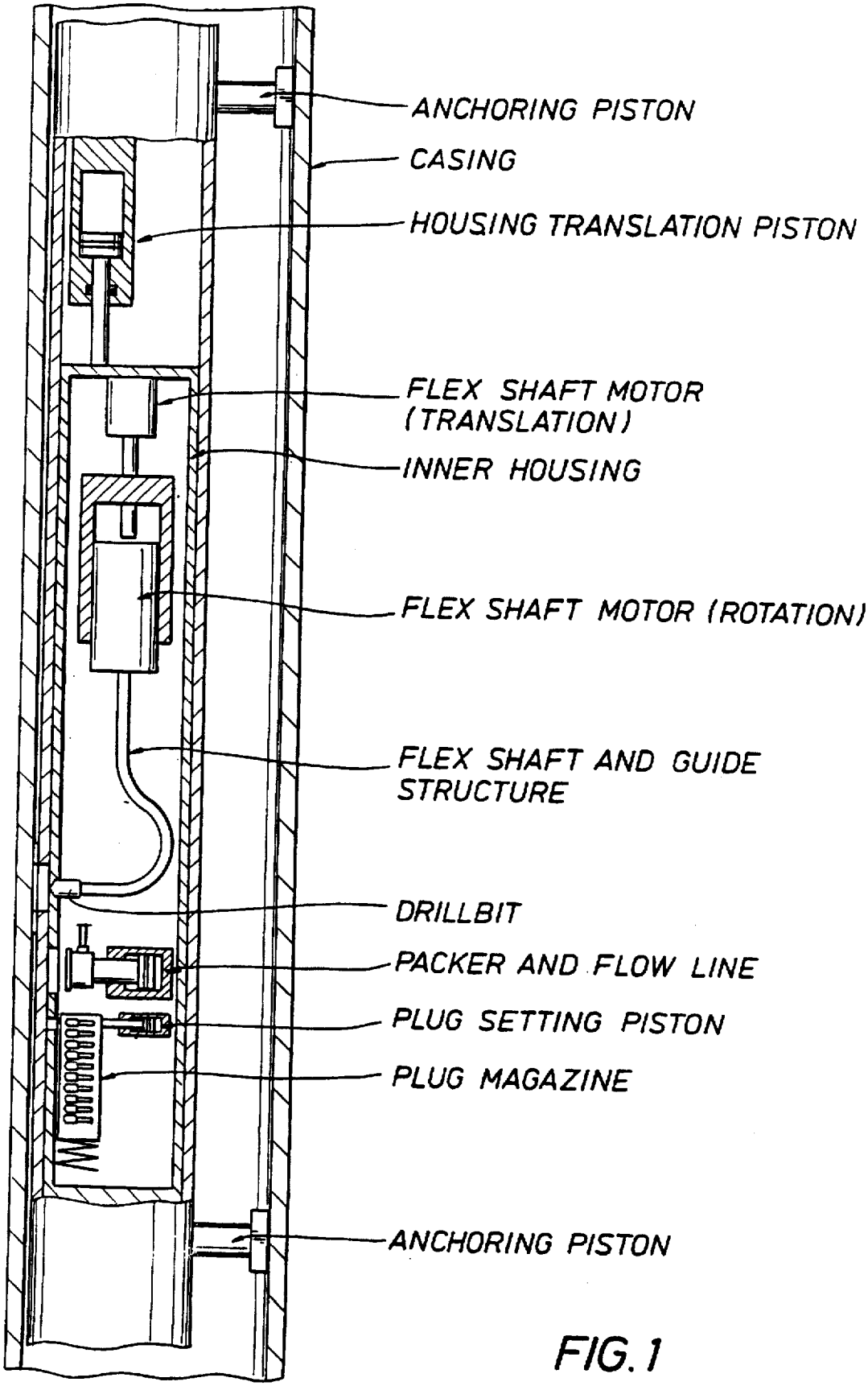
FIG. 1 is a schematic of a formation testing apparatus that is used in a cased borehole environment.

FIG. 1 shows the present invention in the context of a downhole formation tester that perforates a cased borehole, takes a formation sample and reseals the borehole casing. This cased hole tester is described in U.S. patent application Ser. No. 08/603,306 (docket number) 20.2634 filed concurrently with the present invention. The present invention is described in the context of drilling multiple holes through the casing material of a cased borehole. However, the focus of the present invention is on improving the perforating function.

Figure 2:
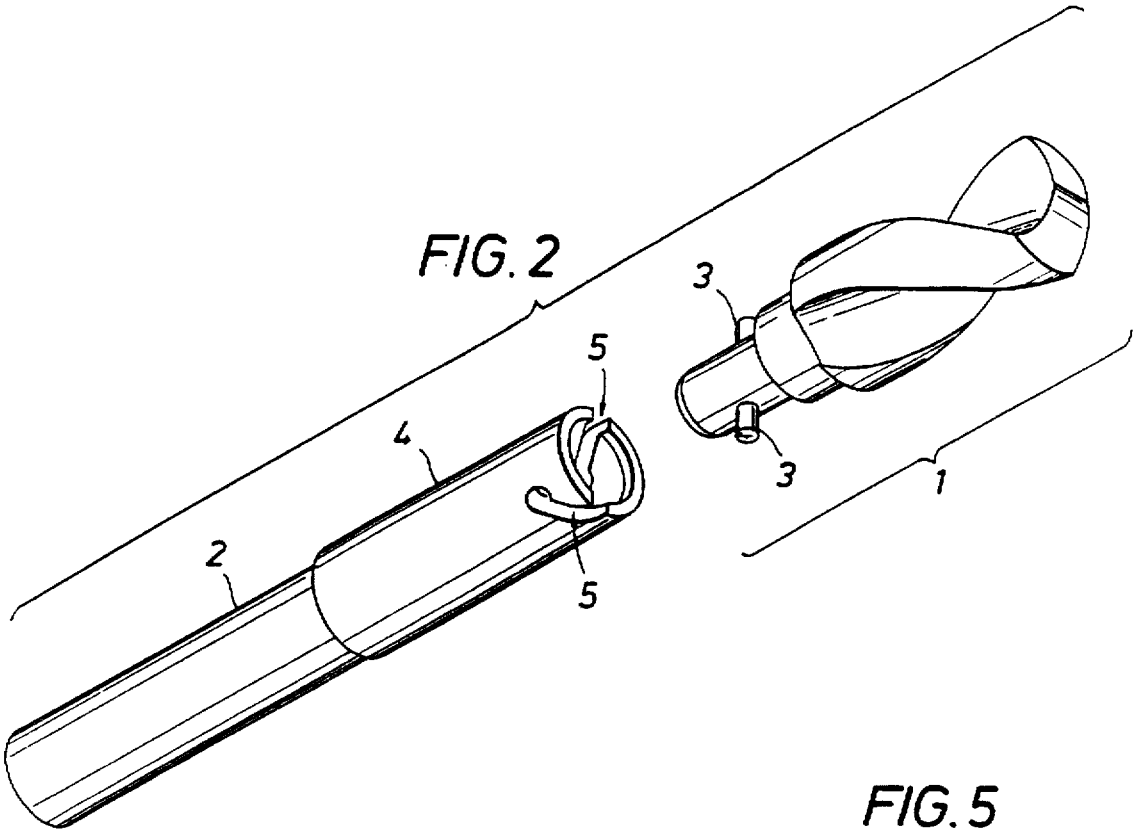
FIG. 2 is an isometric drawing of the drill bit, bayonet-style quick connector and the end of the flexible driveshaft.

In FIG. 2, a drill bit, 1 is shown in line with the flexible driveshaft 2. This drill bit has a length somewhat greater than the thickness of the casing to be drilled and a diameter somewhat greater than the diameter of the flexible driveshaft 2 and coupling 4. To connect the driveshaft 2 to the drill bit 1, the driveshaft 2 must be rotated in a clockwise direction as the two elements (2 and 4) come together. Pins 3 will eventually insert into grooves 5 which locks the drill bit 1 to the driveshaft 2 (as long as the driveshaft 2 maintains a clockwise rotation while drilling). Driving the drill via a flexible shaft allows drilling a hole to a depth greater than the diameter of the drilling apparatus. A translating drive system which can apply both torque and thrust to the flexible driveshaft which is needed and shown in FIG. 1.

In FIG. 3*a*, the top assembly drawing shows a cut-away view of the block 6 with the drilling system in the starting position. The flexible driveshaft 2 is forced to bend ninety degrees by the two guide plates 8. The coupling 4 is in slidable contact with the base 9. The revolver 10 is attached to the base 9 via a screw and bearing (not shown). This screw and bearing allows the revolver 10 to rotate relative to the base 9. The revolver 10 has a plurality of barrels 16 which holds the thrill bits 1, 12. The interior of each barrel 16 is lined with an elastic material such as rubber, glue, or epoxy, which restricts drill bit movements while the drill bits 1, 12 are stored in each barrel 16.In this version of the assembly, there is room for six drill bits 1, 12 aligned about a radius around the center 11 of the revolver 10. Note that drill bit 1 is aligned with the coupling 4, ready for attachment. Drill bit 12, in the illustration, is not aligned with the coupling.

FIG. 3*b* shows a cut-away view of the block 6 with the drilling system in the process of perforating the casing. The flexible driveshaft 2 turns in the clockwise direction while the coupling 4 mates with the drill bit 1 as previously described. Then, using a motor-driven system (see FIG. 1), the flexshaft is advanced out into the casing, cement, and rock while creating the hole.

In FIG. 4*a*, the top cut-away view of the block 6 shows the drilling system back into its starting position. Drill bit 1 has just finished the perforation and is now disconnected from the coupling 4. It is now required of the system to replace bit 1 with a new sharp bit (in this case bit 12).

In FIG. 4*b*, the piston 7 is shown to be sliding along the bore **7*a* within the block 6. This movement is accomplished by using hydraulic fluid and proper and conventional valve techniques. As the piston slides from down to up, the plates 8 (which are rigidly connected to the piston) must also slide in the direction of the piston movement. The plate movement causes the base 9 to move upward as well. Because the revolver 10 is attached to the base 9, it must also slide. In addition to this linear motion, the revolver also rotates about axis 11. This rotation of the revolver is caused by a ratchet mechanism, which will be described in FIG. 5**.

In FIG. 4*c*, the sliding motion of piston 7 through bore 7*a* within block 6 is complete. Note that the revolver 10 has also completed its rotation, whereby drill bit 12 is now aligned with the coupling 4. Hidden behind drill bit 12 (and not shown in this view) is the used dull drill bit 1, which is no longer aligned with the coupling 4. In order to ready the system for the next perforation, piston 7 must be fully reset back to its position shown in FIG. 4*a*.

Figure 5:
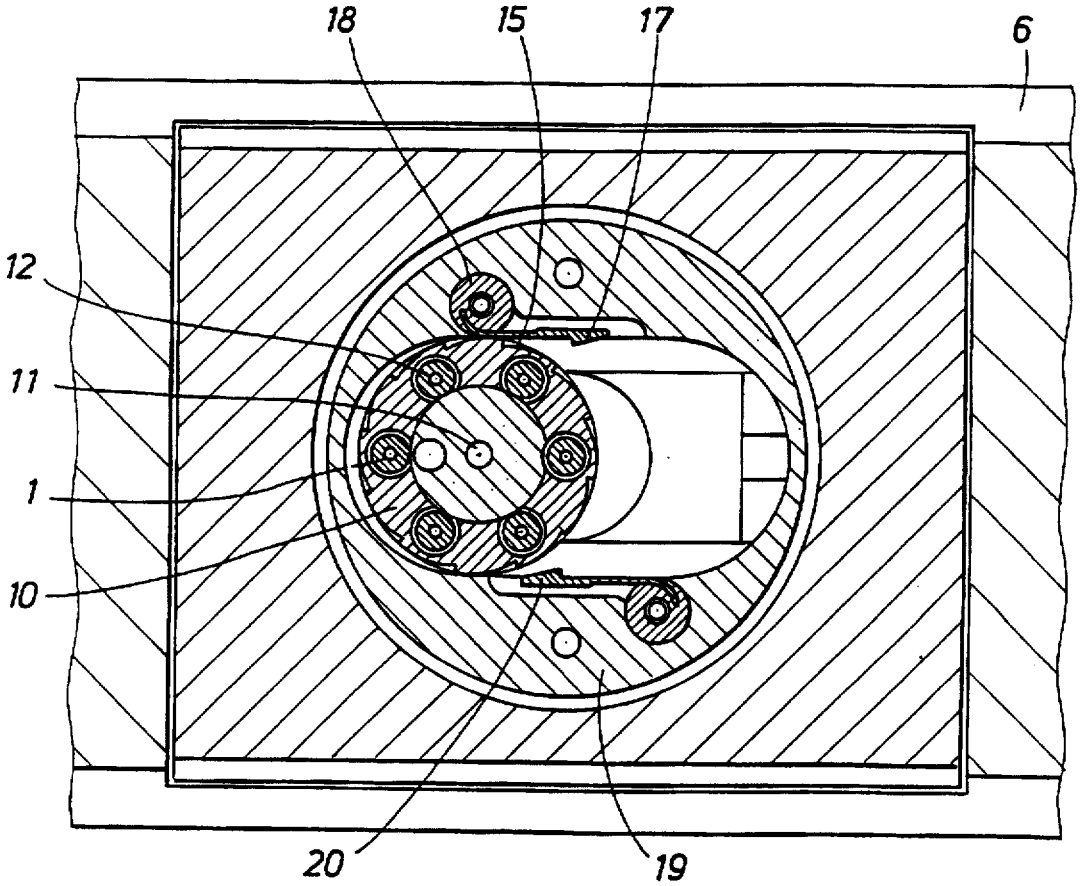
FIG. 5 is a top view (cross-section) of the assembly that illustrates how the ratchet system causes the of the revolver.

As previously mentioned, the rotation of the revolver is caused by the ratchet mechanism shown in FIG. 5. In this cross-sectional top view of the revolver and ratchet system, piston 7 attached to the revolver base 9, not shown, via guide plates 8. The piston moves back and forth causing the guide plates, base and revolver to move in the same direction as the piston. As the revolver 10 begins the linear motion as indicated by the arrow, the saw-toothed groove 15 is contacted by the finger 17. The finger 17 is attached to mount 18, which is rigidly attached to the block 6 via the probe 19. As the revolver 10 continues the linear motion, this contact between groove 15 and finger 17 forces the revolver 10 to rotate about axis 11. This rotation moves drill bit 1 (which is shown to be directly over the unseen coupling 4) counter-clockwise. In addition, it moves all the drill bits through the same rotation. This rotation allows the new drill bit 12 to ultimately align with the coupling.

As shown in FIG. 5, there can also be another finger 20 positioned at the bottom of the slot in probe 19. When this finger 20 is added to the ratchet mechanism, the design constraints are somewhat simplified. That is rather than relying on finger 17 to fully rotate the revolver 10, this upgraded system only requires finger 17 to rotate the revolver 10 halfway. On the return linear motion (from the right to the left), finger 20 contacts another saw-toothed groove, and finishes the counter-clockwise rotation so that the new drill bit 12 is ultimately aligned with the coupling 4.

Figure 6:
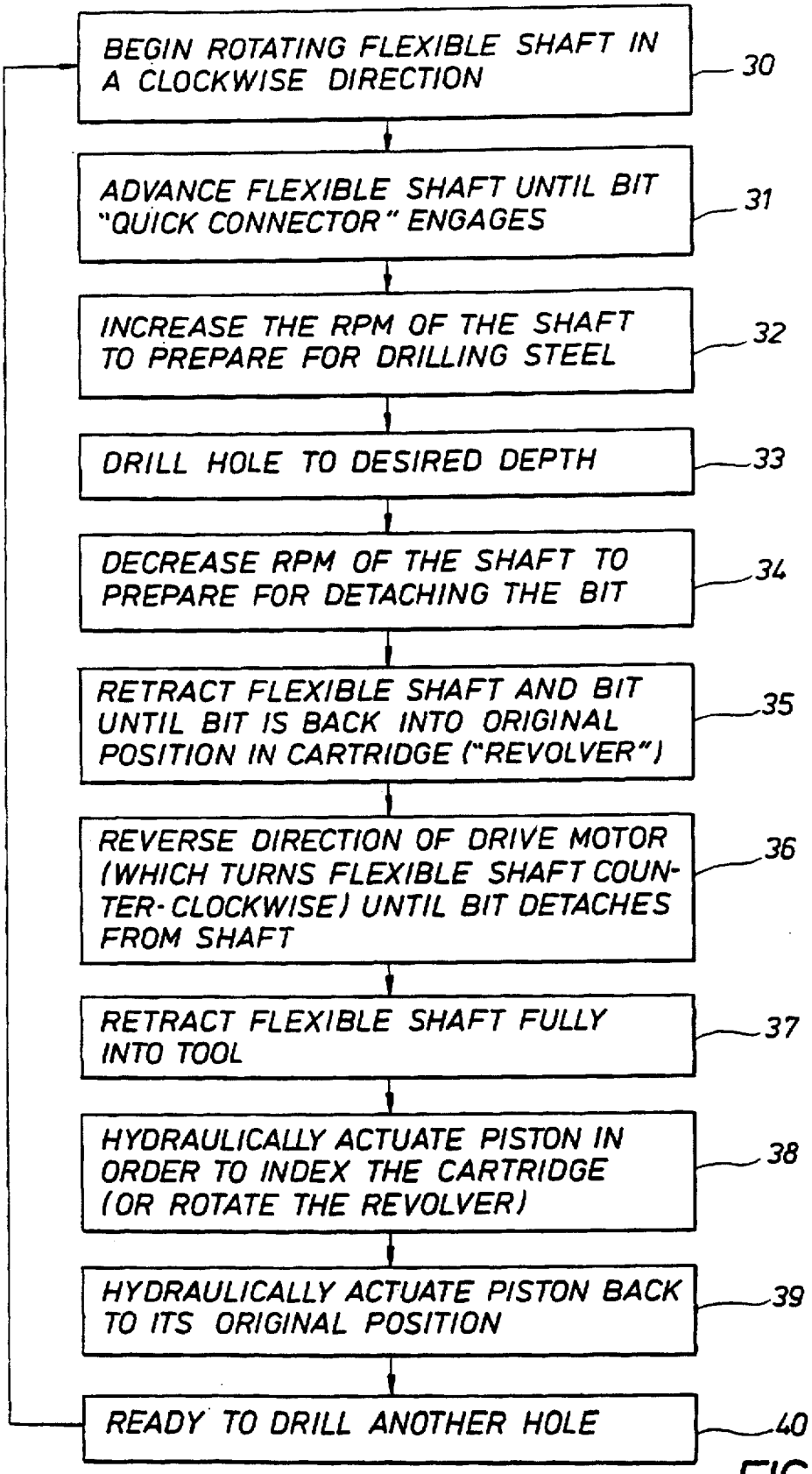
FIG. 6 is a flow diagram of the sequence of the present invention.
Figure 8:
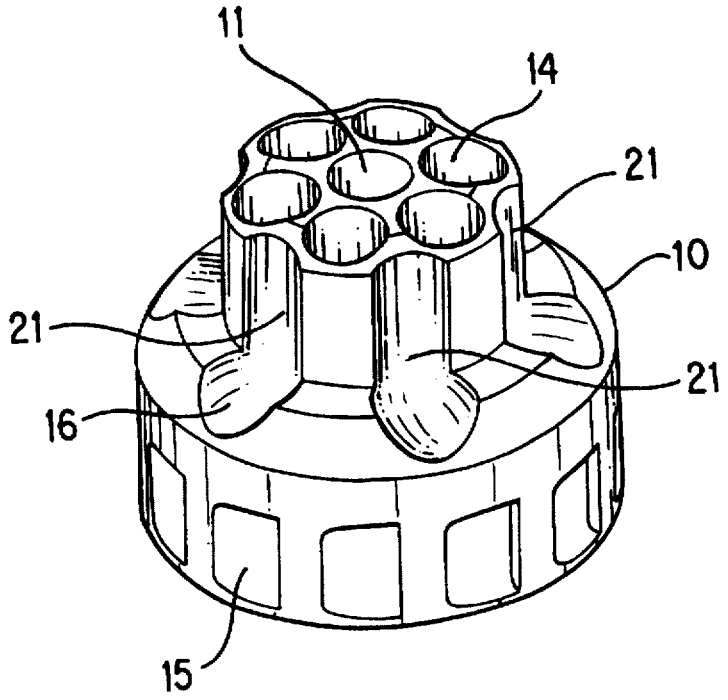
FIG. 8 is a schematic of the revolver that illustrates the lining on the cartridge chambers.

FIG. 6 shows the sequence of the drilling operation performed by the present invention. To begin the operation driveshaft 2 and attached quick connector 4 are rotated in a clockwise manner block 30. The driveshaft is advanced toward the drill bit cartridge until the quick connector engages a drill bit in the cartridge that is aligned with the connector block 31. After the connector engages the drill bit, the RPM's (revolutions per minute) of the driveshaft are increased to prepare for the actual drilling procedure block 32.

The drilling procedure then occurs as indicated in block 33. At the completion of the drilling procedure, the RPM's of the driveshaft are decreased to prepare for the detachment of the drill bit block 34. While still rotating in the clockwise direction, the flexible shaft and drill bit are retracted until the bit is back in original position in the cartridge 35. Now that the drill bit is in its original position, the rotation of the driveshaft is reversed until the drill bit detached from the shaft 36. The next step is to retract the flexible shaft into the tool 37 to permit the rotating of the revolver 38. The revolver is rotated via a hydraulically activated piston 7. The revolver is rotated as shown in FIG. 5. Once the revolver is rotated and the next drill bit to be used is aligned with the flexible shaft 2, the hydraulically actuated piston is returns to its original position 39. Now the system is ready to repeat the process and drill another hole 40.

Another embodiment of the present invention is shown in FIG. 7. This isometric drawing shows a revolver 10 with the usual barrels 14 for the six drill bits. As previously described, these barrels are aligned about a radius around the central axis 11. In addition to this, another concentric series of six barrels 16 have been added. These barrels 16 contain the plugs that are used to reseal the perforations as needed by the tool shown in FIG. 1. However, it is important to note that the inventors recognize that the revolver can house more that just drill bits and the rotation motion can be used to index a multitude of operations.

Although a revolver type cartridge embodiment is described herein, there are types of cartridges that can be used in this invention. One such cartridge can have alternating bits and plugs stacked consecutively in a magazine.

Appropriate means can be connected to the magazine to align bits and plugs for desired drilling and plugging operations.

In addition, the revolver concepts can be implemented in embodiments other than those described herein. The revolver has applications in any operation or drilling system where multiple drilling operations occur during a single borehole run of a tool.

The method and apparatus of the present invention provides a significant advantage over the prior art. The invention has been described in connection with the preferred embodiments. However, the invention is not limited thereto. Changes, variations and modifications to the basic design may be made without departing from the inventive concept in this invention. In addition, these changes, variations and modifications would be obvious to those skilled in the art having the benefit of the foregoing teachings contained in this application. All such changes, variations and modifications are intended to be within the scope of the invention which is limited by the following claims.

We claim:

1. A flexible shaft drilling system to be positioned in a borehole traversing an earth formation for drilling through a material from said borehole, comprising:

a) a plurality of drill bits to be brought in contact with said material;

b) a drill bit cartridge having a plurality of chambers in which said plurality of drill bits rest when not used;

c) a lining fixably attached to an inner surface of said plurality of chambers to restrict movement of each drill bit when not used;

d) a flexible shaft having the capability of engaging any of said plurality of drill bits;

e) an actuator connected to said flexible shaft that rotates said flexible shaft and engages said drill bit during said drilling process; and f) a means for exchanging any drill bit of said plurality between each of a succession of drilling perforation into said material.

2. The system of claim 1 wherein said drill bit cartridge is a revolver.

3. The system of claim 1 wherein said means for exchanging the said drill bits comprises:

a connector between the said flexible shaft and the said drill bit; and a means to index said cartridge so that successive bits can be connected to the said flexible shaft.

4. The system of claim 3 wherein said connector is a bayonet-style "quick connector".

5. The system of claim 3 wherein said index means comprises:

a base attached to said drill bit cartridge; and a piston attached to said base to provide for movement of said base when indexing.

6. The system of claim 5 wherein said drill bit cartridge has an outer surface containing recesses to facilitate indexing.

7. The system of claim 6 further comprising an indexing finger that engages the holder via the recess when indexing said cartridge.

8. The system of claim 7 wherein said indexing finger has a lip portion that engages the holder.

9. The system of claim 7 further comprising a second indexing finger that engages the cartridge when indexing said cartridge.

10. The system of claim 1 wherein said lining is rubber.

11. A method for drilling through a material using a drilling system that includes a plurality of drill bits, a flexible drilling shaft, and a cartridge to hold said plurality of drill bits, comprising the step of:

a) bringing a drill bit connected to said drilling shaft in contact with said material to be drilled;

b) drilling through said material;

c) retracting said drilled material;

d) indexing said cartridge to replace said drill bit with a new bit, said indexing step comprising:

i) moving the cartridge in a direction such that the outer surface of said cartridge engages a stationary device causing said cartridge to rotate a predetermined distance; and ii) returning said cartridge to a position of said cartridge during the drilling procedure;

e) replacing said drill bit with said new bit from said cartridge; and, f) repeating steps (a) through (e).

12. The method of claim 11 further comprising before step (a) the step of rotating said flexible flexible shaft in order to connect said flexible shaft to said drill bit.

13. The method of claim 11 wherein the step of replacing said drill bit further comprises the steps of:

detaching said drill bit from said flexible shaft;

retracting said shaft from said drill bit cartridge to allow indexing of said cartridge;

indexing said cartridge such that a new drill bit is aligned for attachment to said flexible shaft.

14. The method of claim 11 wherein said outer surface of said cartridge engages a stationary means causing said cartridge to rotate a predetermined distance when returning said cartridge to its drilling position.

15. The method of claim 11 wherein said cartridge is moved by applying force to a piston attached to said cartridge.

16. A drilling system in a borehole traversing an earth formation for drilling through a material from said borehole, comprising:

a) a plurality of drill bits for drilling through said material;

b) a means for holding said plurality of drill bits when said bits are not in use;

c) a lining fixably attached to an inner surface of said holding means to restrict movement of each drill bit when not used;

d) an actuating means for rotating said drill bit during a drilling procedure;

e) a flexible connecting means having two ends, one end connected to said actuating means and the other end connected to said drill bit to use in said drilling procedure;

f) means for accessing a new bit from said plurality of drill bits between successive drilling operations and, g) means for holding a plurality of plugs for plugging perforations in said material created from said drilling procedure.

17. The drilling system of claim 16 wherein said bit accessing means comprises:

a means to attach said flexible connecting means to said drill bit; and a means to adjust said drill bit holder means such that a different drill bit is used for each successive drilling procedure.

18. The drilling system of claim 17 wherein said drill bit holding means has a plurality of chambers, each chamber to hold one drill bit.

19. The drilling system of claim 18 wherein said drill bit holding means is a revolver.

20. The drilling system of claim 19 wherein said bit adjustment means comprises:

a base attached to said revolver;

a piston attached to said base to provide for movement of said base and revolver; and a means to engage said revolver during said piston movement.

21. The drilling system of claim 20 wherein said revolver has an outer surface containing recesses to facilitate engaging of said revolver by said engaging means.

* * * * *